US010161329B2

(12) United States Patent
Lack et al.

(10) Patent No.: US 10,161,329 B2
(45) Date of Patent: Dec. 25, 2018

(54) UPSTREAM $NO_x$ ESTIMATION

(71) Applicant: INTERNATIONAL ENGINE INTELLECTUAL PROPERTY COMPANY, LLC, Lisle, IL (US)

(72) Inventors: Adam C. Lack, Boulder, CO (US); Navtej Singh, Arlington Heights, IL (US); Michael James Miller, Mt. Prospect, IL (US)

(73) Assignee: International Engine Intellectual Property Company, LLC, Lisle (IL)

( * ) Notice: Subject to any disclaimer, the term of this patent is extended or adjusted under 35 U.S.C. 154(b) by 417 days.

(21) Appl. No.: 14/893,386

(22) PCT Filed: May 25, 2013

(86) PCT No.: PCT/US2013/042777
§ 371 (c)(1),
(2) Date: Nov. 23, 2015

(87) PCT Pub. No.: WO2014/193333
PCT Pub. Date: Dec. 4, 2014

(65) Prior Publication Data

US 2016/0123258 A1 May 5, 2016

(51) Int. Cl.

| | |
|---|---|
| ***F02D 41/02*** | (2006.01) |
| ***F02D 41/14*** | (2006.01) |
| ***F01N 3/20*** | (2006.01) |
| *F02D 41/10* | (2006.01) |

(52) U.S. Cl.
CPC ..... *F02D 41/0235* (2013.01); *F01N 3/208* (2013.01); *F02D 41/146* (2013.01); *F02D 41/1446* (2013.01); *F02D 41/1454* (2013.01); *F02D 41/1461* (2013.01); *F02D 41/1462* (2013.01); *F01N 3/2066* (2013.01); *F01N 2900/0601* (2013.01); *F01N 2900/08* (2013.01); *F02D 41/10* (2013.01);
(Continued)

(58) Field of Classification Search
CPC ..... F02D 41/0235; F02D 41/1446; F02D 41/1454; F02D 41/1461; F02D 41/1462; F02D 41/10; F02D 2041/1472; F02D 2200/0408; F02D 2200/1004; F02D 2250/36; F01N 3/208; F01N 3/2066; F01N 2900/0601; F01N 2900/08
USPC ..... 60/285
See application file for complete search history.

(56) References Cited

U.S. PATENT DOCUMENTS

2011/0214650 A1* 9/2011 Wang ..... F02D 41/00 123/703

* cited by examiner

*Primary Examiner* — Phutthiwat Wongwian
*Assistant Examiner* — Kelsey Stanek
(74) *Attorney, Agent, or Firm* — Jeffrey P. Calfa; Jck D. Nimz

(57) ABSTRACT

A method for controlling operation of an internal combustion engine determines an estimated NOx value as a function of at least one engine operating parameter. The method also determines an actual NOx value using a NOx sensor positioned in an exhaust gas stream of the internal combustion engine. The method detects at least one condition indicative of whether or not the actual NOx value is accurate. The actual NOx value is used for controlling engine operation when the at least one condition indicates that the actual NOx value is accurate, while the estimated NOx value is used for controlling engine operation when the at least one condition indicates that the actual NOx value is inaccurate.

13 Claims, 6 Drawing Sheets

(52) U.S. Cl.
CPC ..... *F02D 2041/1472* (2013.01); *F02D 2200/0408* (2013.01); *F02D 2200/1004* (2013.01); *F02D 2250/36* (2013.01)

UPSTREAM $NO_x$ ESTIMATION

BACKGROUND

Selective catalytic reduction (SCR) is commonly used to remove $NO_x$ (i.e., oxides of nitrogen) from the exhaust gas produced by internal engines, such as diesel or other lean burn (gasoline) engines. In such systems, $NO_x$ is continuously removed from the exhaust gas by injection of a reductant into the exhaust gas prior to entering an SCR catalyst capable of achieving a high conversion of $NO_x$.

Ammonia is often used as the reductant in SCR systems. The ammonia is introduced into the exhaust gas by controlled injection either of gaseous ammonia, aqueous ammonia or indirectly as urea dissolved in water. The SCR catalyst, which is positioned in the exhaust gas stream, causes a reaction between $NO_x$ present in the exhaust gas and a NO reducing agent (e.g., ammonia) to convert the $NO_x$ into nitrogen and water.

Proper operation of the SCR system involves precise control of the amount (i.e., dosing level) of ammonia (or other reductant) that is injected into the exhaust gas stream. Injection of too much reductant causes a slip of ammonia in the exhaust gas, whereas injection of a too little reductant causes a less than optimal conversion of $NO_x$. Thus, SCR systems often utilize $NO_x$ sensors in order to determine proper reactant dosing levels. For example, a $NO_x$ sensor can be positioned in the exhaust stream between the engine and the SCR catalyst for detecting the level of $NO_x$ that is being emitted from the engine. This is commonly referred to as an engine out $NO_x$ sensor or an upstream $NO_x$ sensor. An electronic control unit (ECU) can use the output from the engine out $NO_x$ sensor (and/or other sensed parameters) to determine the amount of reductant that should to be injected into the exhaust stream.

For example, the accuracy of $NO_x$ sensors can be affected by environmental and/or operating conditions such as dew point, system voltage, oxygen concentration, and the like. For example, some $NO_x$ only work properly when the exhaust gas is above a threshold temperature which can be on the order of 125-130° C. As a result, such sensors may not suitable for determining dosing levels during certain engine operating conditions, such as low idle or engine warm-up. Hence, it is desirable to provide an alternative method for determining the $NO_x$ level in an engine's exhaust, particularly during conditions when a $NO_x$ sensor is prone to producing inaccurate readings. It may also desirable to be able to switch between control based on the $NO_x$ sensor and/or the alternative $NO_x$ determination method based on operational and/or environmental conditions.

SUMMARY

Aspects and embodiments of the present technology described herein relate to one or more systems and methods for controlling the operation of an engine. According to at least one aspect of the present technology, a method for controlling operation of an internal combustion engine determines an estimated $NO_x$ value as a function of at least one engine operating parameter. The method also determines an actual $NO_x$ value using a $NO_x$ sensor positioned in an exhaust gas stream of the internal combustion engine. The method detects at least one condition indicative of whether or not the actual $NO_x$ value is accurate. The actual $NO_x$ value is used to control engine operation when the at least one condition indicates that the actual $NO_x$ value is accurate, while the estimated $NO_x$ value is used to control engine operation when the at least one condition indicates that the actual $NO_x$ value is inaccurate.

According to certain aspects of the present technology, the at least one condition can include one or more of exhaust gas temperature, dew point, system voltage, exhaust gas oxygen concentration, and the like.

According to at least one embodiment, the at least one condition may be exhaust gas temperature. In some embodiments, engine operation is controlled using the actual $NO_x$ value when the exhaust gas temperature is at or above a temperature threshold, while engine operation is controlled using the actual $NO_x$ value when the exhaust gas temperature is below the temperature threshold. According to some embodiments, the at least one condition may be exhaust gas oxygen concentration. In some embodiments engine operation may controlled using the actual $N_{Ox}$ value when the exhaust gas oxygen concentration is as at or above an oxygen concentration threshold, while engine operation may be controlled using the estimated $N_{Ox}$ value when the exhaust gas oxygen concentration is below the oxygen concentration threshold.

In some embodiments, the at least one condition may be dew point or humidity. Engine operation may be controlled using the actual $NO_x$ value when the dew point is at or above a dew point threshold, while engine operation may be controlled using the estimated $NO_x$ value when dew point is below the dew point threshold.

At least some embodiments of the present technology relate to a method for controlling operation of an internal combustion engine by determining an actual $NO_x$ value using a $NO_x$ sensor positioned in an exhaust gas stream of the internal combustion engine. The method also determines a steady state $NO_x$ estimate as a function of at least engine speed and torque. The steady state $NO_x$ corresponds to the $NO_x$ level output by the engine during a substantially steady state operation where engine speed and power are substantially constant. The method further determines a transitory $NO_x$ estimate as a function of at least engine speed and torque. The transitory $NO_x$ estimate corresponds to the $NO_x$ level output by the engine during a transitory operation where engine power is increasing. The method also determines a compensation factor based on intake manifold pressure and applies the compensation factor to the steady state and transitory $NO_x$ estimates to arrive at a final $NO_x$ estimate. In some embodiments, the compensation factor weights the final $NO_x$ estimate towards the transitory $NO_x$ estimate with decreasing intake manifold pressure. The method detects at least one condition indicative of whether or not the actual $NO_x$ value is accurate. The actual $NO_x$ value may be used to control engine operation when the at least one condition indicates that the actual $NO_x$ value is accurate, while the estimated $NO_x$ value may be used to control engine operation when the at least one condition indicates that the actual $NO_x$ value is inaccurate.

DETAILED DESCRIPTION

Various examples of embodiments of the present technology will be described more fully hereinafter with reference to the accompanying drawings, in which such examples of embodiments are shown. Like reference numbers refer to like elements throughout. Other embodiments of the presently described technology may, however, be in many different forms and are not limited solely to the embodiments set forth herein. Rather, these embodiments are examples representative of the present technology. Rights based on this disclosure have the full scope indicated by the claims.

Figure 1:
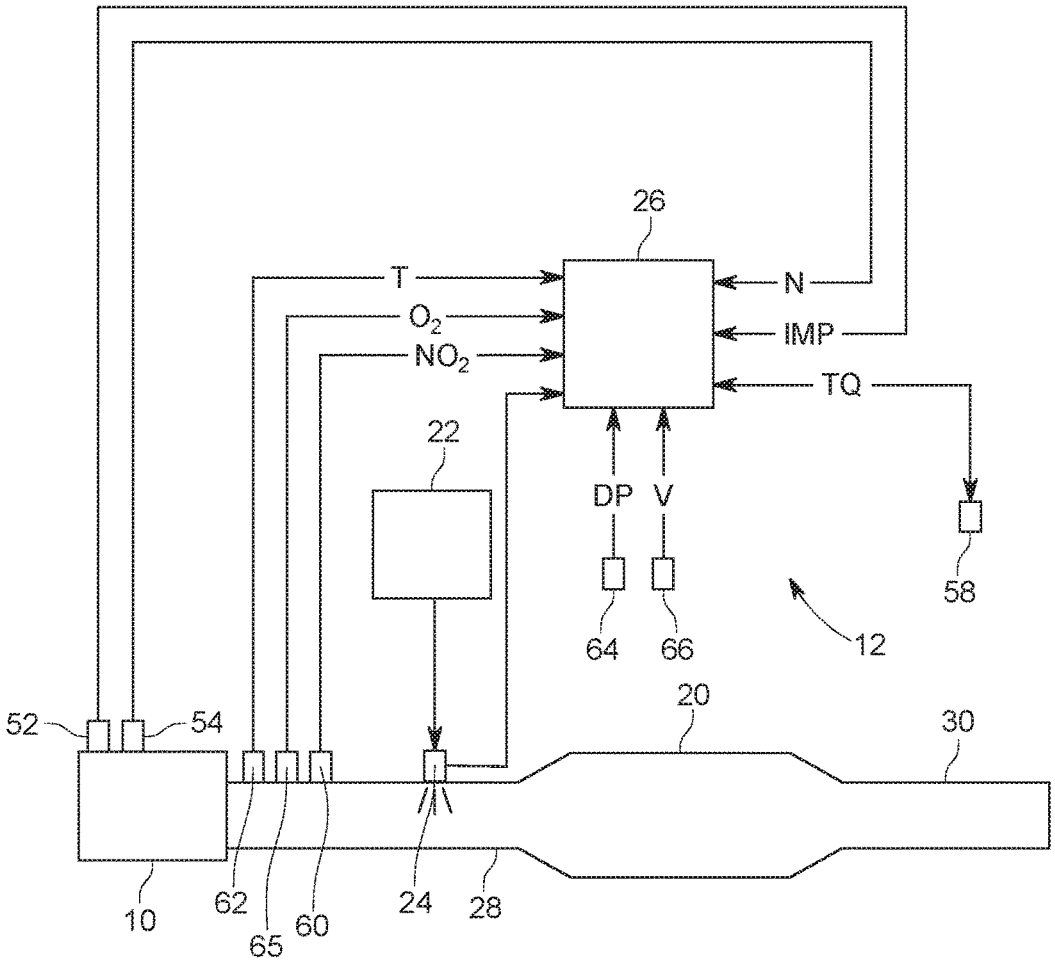
FIG. 1 is a schematic illustration of an internal combustion engine with an exhaust gas SCR system.

FIG. 1 shows an exemplary schematic depiction of an internal combustion engine 10 and an SCR system 12 for reducing $NO_x$ from the engine's exhaust. The engine 10 can be used, for example, to power a vehicle such as an over-the-road vehicle (not shown). The engine 10 can be a compression ignition engine, such as a diesel engine, for example. Generally speaking, the SCR system 12 includes a catalyst 20, a reductant supply 22, a reductant injector 24, an electronic control unit 26, and one or more parameters sensors.

The ECU 26 controls delivery of a reductant, such as ammonia, from the reductant supply 22 and into the exhaust system 28 through the reductant injector 24. The reductant supply 22 can include canisters (not shown) for storing ammonia in solid form. In most systems, a plurality of canisters will be used to provide greater travel distance between recharging. A heating jacket (not shown) is typically used around the canister to bring the solid ammonia to a sublimation temperature. Once converted to a gas, the ammonia is directed to the reductant injector 24. The reductant injector 24 is positioned in the exhaust system 28 upstream from the catalyst 20. As the ammonia is injected into the exhaust system 28, it mixes with the exhaust gas and this mixture flows through the catalyst 20. The catalyst 20 causes a reaction between $NO_x$ present in the exhaust gas and a $NO_x$ reducing agent (e.g., ammonia) to reduce/convert the $NO_x$ into nitrogen and water, which then passes out of the tailpipe 30 and into the environment. While the SCR system 12 has been described in the context of solid ammonia, it will be appreciated that the SCR system could alternatively use a reductant such as pure anhydrous ammonia, aqueous ammonia or urea, for example.

According to at least some embodiments, the ECU 26 controls engine operation and operation of the SCR system 12, including operation of the reductant injector 24, based on a plurality of operating parameters. In the exemplary embodiment, the operating parameters include intake manifold pressure (IMP), engine speed (N) (i.e., rotational speed), engine load or torque (TQ) and the level of $NO_x$ in engine's exhaust (Engine Out $NO_x$). The intake manifold pressure (IMP) can be determined via a pressure sensor 52 positioned to sense the pressure in the engine's intake manifold and produce a responsive output signal. The engine speed (N) can be determined using a sensor 54 to detect the rotation speed of the engine, e.g., crankshaft rpm. Engine load (TQ) can be based on accelerator pedal position as measured by a sensor 58 or fuel setting, for example.

As explained in greater detail, the ECU 26 may estimate the level of $NO_x$ in engine's exhaust based on one or more engine operating parameters. For example, in at least some embodiments, the ECU 26 can determine an estimated $NO_x$ value based on the engine speed (N), load (TQ) and intake manifold pressure (IMP). In addition, the ECU 26 may determine an actual level of $NO_x$ value using a $NO_x$ sensor 60 positioned in the engine's exhaust gas stream, e.g., between the engine 10 and the catalyst 20. The ECU 26 may also detect one or more conditions indicative of whether or not the actual $NO_x$ value is accurate. For example, the ECU may monitor one or more of exhaust gas temperature (T) via a temperature sensor 62, dew point (DP) via a dew point sensor 64, oxygen concentration ($O_2$) in the exhaust system via an oxygen sensor 65, and system voltage (V) via a voltage sensor 66. In some embodiments, the ECU 26 controls engine operation using the actual $NO_x$ value when the at least one condition indicates that the actual $NO_x$ value is accurate, but uses the estimated $NO_x$ value to control engine operation when the at least one condition indicates that the actual $NO_x$ value may be inaccurate.

In addition to controlling the dosing or metering of ammonia, the ECU 26 can also store information such as the amount of ammonia being delivered, the canister providing the ammonia, the starting volume of deliverable ammonia in the canister, and other such data which may be relevant to determining the amount of deliverable ammonia in each canister. The information may be monitored on a periodic or continuous basis. When the ECU 26 determines that the amount of deliverable ammonia is below a predetermined level, a status indicator (not shown) electronically connected to the controller 26 can be activated.

Figure 2:
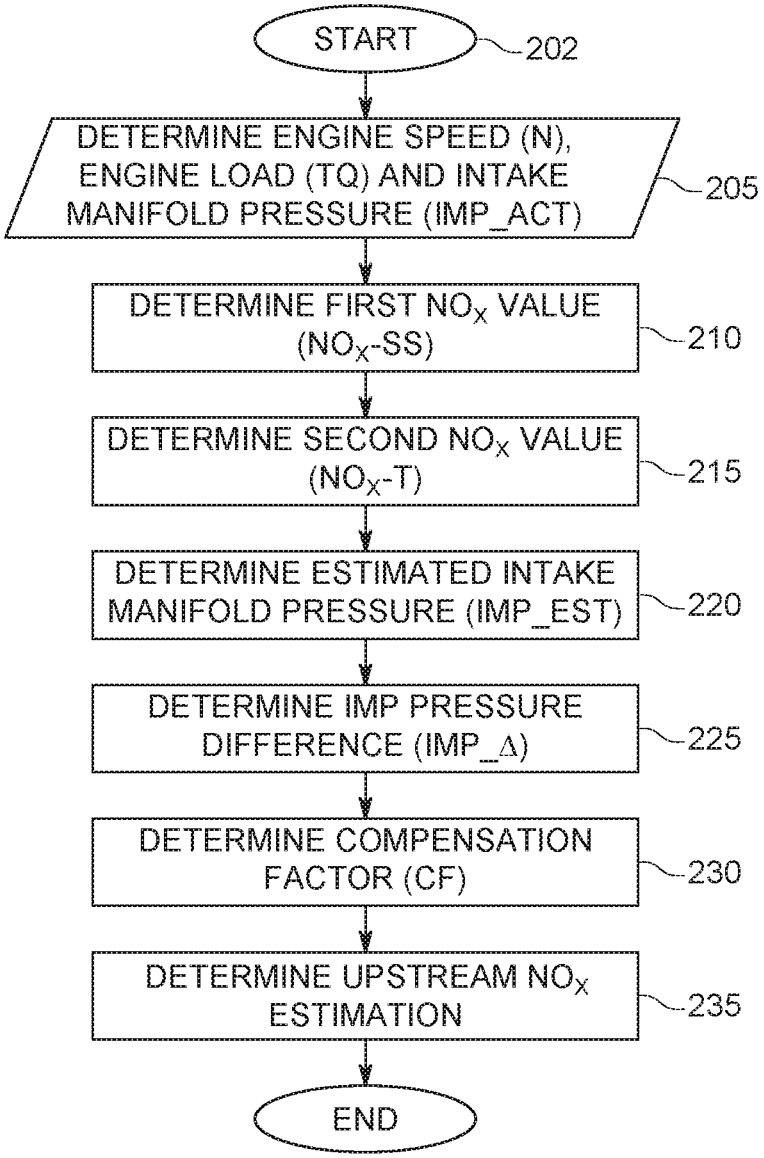
FIG. 2 is a flow diagram of an exemplary method for determining the $NO_x$ level in an engine's exhaust according to certain embodiments of the present technology.

FIG. 2 is a flow chart of an exemplary method 200 for determining the $NO_x$ level in an engine's exhaust in accordance with certain aspects of the present technology. The method 200 begins in step 202. Control is then passed to the step 205, where the exemplary method determines the engine speed (N), the engine load (TQ) and the actual intake manifold pressure (IMP_ACT), e.g., by reading the output from the sensors 52, 54, 58.

Control is then passed to step 210, where the method 200 determines a first $NO_x$ value or estimate ($NO_x$_SS) as a function of engine speed (N) and engine load (TQ). The first $NO_x$ estimate ($NO_x$_SS) corresponds to the $NO_x$ output by engine under a first engine operating condition (and at a given speed (N) and load (TQ) combination). In some embodiments, the first operating condition corresponds to substantially "steady state" operation of the engine, i.e., at constant or slowly changing engine speed. In some embodiments, the method 200 determines the first $NO_x$ estimate ($NO_x$_SS) by accessing a look-up table or map that provides an estimate of the $NO_x$ level produced by the engine at the given engine speed (N) and load (TQ) during the first operating condition (e.g., steady state operation). The look-up table can, for example, be empirically constructed by operating the engine in the first operating condition and measuring actual $NO_x$ level, i.e., with a $NO_x$ sensor, at different engine speed and load combinations.

Control is then passed to step 215 where the method determines a second $NO_x$ value or estimate ($NO_x$_T) as a function of engine speed (N) and engine load (TQ). The second $NO_x$ estimate ($NO_x$_T) corresponds to the $NO_x$ output by the engine during a second operating condition (and at a given engine speed (N) and load (TQ) combination). In some embodiments, the second operating condition corresponds to "transient" operation where engine power is increasing, e.g., during acceleration of a vehicle. In some embodiments, the method 200 determines the second $NO_x$ value ($NO_x$_T) by accessing a look-up table or map that provides an estimate of the $NO_x$ level produced by the engine at the given engine speed (N) and load (TQ) under the second operating condition (e.g., transient operation).

Next, in step 220 the method 200 determines an estimated intake manifold pressure (IMP_EST) as a function of at least engine speed (N) and torque (TQ). In the exemplary embodiment, the estimated intake manifold pressure (IMP_EST) corresponds to the engine's intake manifold pressure when the engine is under the first operating condition (and at a given engine speed (N) and load (TQ) combination). In some embodiments, the method determines the estimated intake manifold pressure (IMP_EST) by accessing a look-up table or map that provides an estimate of the intake manifold pressure (IMP) at the given engine speed (N) and load (TQ) during the first operating condition (e.g., steady state operation). The look-up table can, for example, be empirically constructed by operating the engine in the first mode and measuring actual intake manifold pressure, i.e., with a sensor, at different engine speed and load combinations.

Control is then passed to step 225 where the method 200 determines a pressure difference (IMP_Δ) between the estimated intake manifold pressure (IMP_EST) and the actual intake manifold pressure (IMP_ACT). Control is then passed to step 230 where the method determines a compensation factor (CF) based on the pressure difference (IMP_Δ) between the estimated and actual intake manifold pressures. According to some embodiments, the compensation factor ranges from 0 when the pressure difference is at first threshold and 1 when the pressure difference is at a second threshold.

Control is then passed to step 235 where the method 200 determines the estimated NOx level being output from the engine ($NO_x$_OUT_EST). In some embodiments, the $NO_x$ output by the engine is determined as a function of the compensation factor and the first and second $NO_x$ estimates. According to at least some as embodiments of the present technology, the estimated engine out $NO_x$ ($NO_x$_OUT_EST) can be determined in accordance with the following equation.

$$NO_x_OUT_EST=(CF\cdot NO_x_T)+((1-CF)\cdot NO_x_SS)$$

The estimated engine at $NO_x$ ($NO_x$_OUT_EST) can be used by the ECU in controlling the SCR system, including controlling the reductant value in order to control dosing of reductant into the exhaust system 28.

Figure 3:
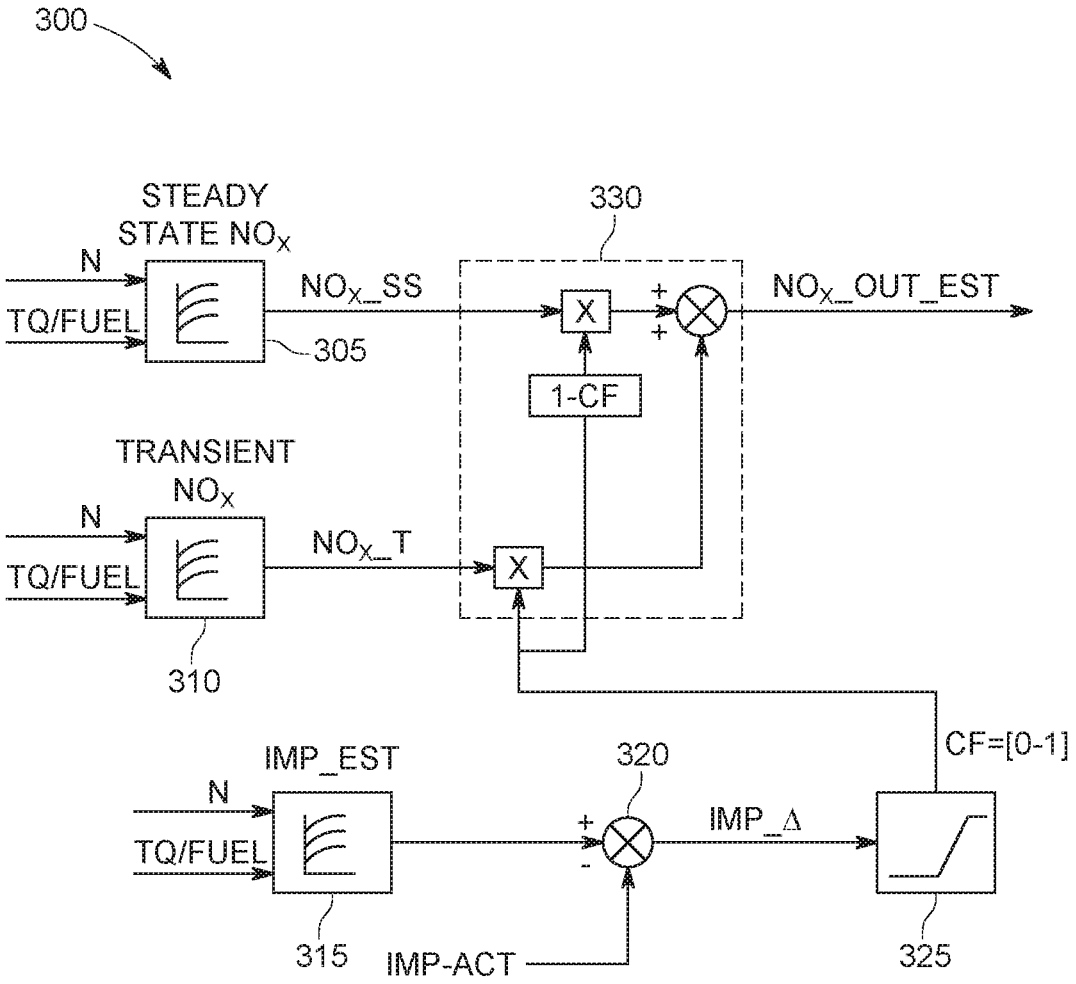
FIG. 3 is a schematic of exemplary control logic for determining the $NO_x$ level in an engine's exhaust according to certain embodiments of the present technology.

FIG. 3 is a schematic of exemplary control logic 300 for determining the $NO_x$ level in an engine's exhaust in accordance with certain aspects of the present technology. The control logic includes a first block 305 that determines a first $NO_x$ value (or estimate) ($NO_x$_SS) as a function of at least engine speed (N) and engine load (TQ). The first $NO_x$ estimate ($NO_x$_SS) output by the first logic block 305 corresponds to the $NO_x$ output by engine under a first engine operating condition (and at a given speed (N) and load (TQ) combination). In some embodiments, the first operating condition corresponds to substantially "steady state" operation of the engine, i.e., at constant or slowly changing engine speed. In at least some embodiments, the control logic 300 determines the first $NO_x$ value ($NO_x$_SS) by accessing a look-up table or map that provides an estimate of the $NO_x$ level produced by the engine at the given engine speed (N) and load (TQ) during the first operating condition (e.g., steady state operation). The look-up table can, for example, be empirically constructed by operating the engine in the first operating condition and measuring actual $NO_x$ level, i.e., with a $NO_x$ sensor, at different engine speed and load combinations.

The control logic 300 also includes a second logic block 310 that determines a second $NO_x$ value (or estimate) ($NO_x$_T) as a function of at least engine speed (N) and engine load (TQ). The second $NO_x$ estimate ($NO_x$_T) output by the second logic block 310 corresponds to the $NO_x$ output by the engine during a second operating condition (and at a given engine speed (N) and load (TQ) combination). In at least some embodiments, the second operating condition corresponds to "transient" operation where engine power is increasing, e.g., during acceleration of a vehicle. In some embodiments, the control logic 300 determines the second $NO_x$ value ($NO_x$_T) by accessing a look-up table or map that provides an estimate of the $NO_x$ level produced by the engine at the given engine speed (N) and load (TQ) under the second operating condition (e.g., transient operation). The look-up table can be empirically constructed by operating the engine under the second condition and measuring the actual $NO_x$ level, i.e., with a sensor, output from the engine at different speed and load combinations.

Control logic 300 also includes a third logic block 315 that determines an estimated intake manifold pressure (IMP_EST) as a function of at least engine speed (N) and torque (TQ). In at least one embodiment, the estimated intake manifold pressure (IMP_EST) corresponds to the engine's intake manifold pressure when the engine under the first operating condition (and at a given engine speed (N) and load (TQ) combination). According to some embodiments, the estimated intake manifold pressure (IMP_EST) corresponds to the engine's intake manifold pressure when the engine is operating at steady state (and at a given engine speed (N) and load (TQ) combination). In some embodiments, the control logic determines the estimated intake manifold pressure (IMP_EST) by accessing a look-up table or map that provides an estimate of the intake manifold pressure (IMP) at the given engine speed (N) and load (TQ) during the first operating condition (e.g., steady state operation). The look-up table can, for example, be empirically constructed by operating the engine in the first operating condition (e.g., steady state operation) and measuring actual intake manifold pressure, i.e., with a sensor, at different engine speed and load combinations.

Control logic includes logic 320 for calculating a pressure difference (IMP_Δ) between the estimated intake manifold pressure (IMP_EST) and the actual intake manifold pressure (IMP_ACT). A fourth logic block 325 determines a compensation factor (CF) as a function of the pressure difference (IMP_Δ) between the estimated and actual intake manifold pressures. According to some embodiments, the compensation factor (CF) ranges from 0 when the pressure difference is at first threshold and 1 when the pressure difference is at a second threshold. The control logic also includes logic 330 for estimating $NO_x$ level being output from the engine ($NO_x$_OUT_EST) as a function of the compensation factor (CF), the first $NO_x$ estimate ($NO_x$_SS) and the second $NO_x$ estimate ($NO_x$_T). According to at least some embodiments of the present technology, the estimated engine output $NO_x$ ($NO_x$_OUT_EST) can be determined in accordance with the following equation.

$$NO_x_OUT_EST=(CF\cdot NO_x_T)+((1-CF)\cdot NO_x_SS)$$

Figure 4:
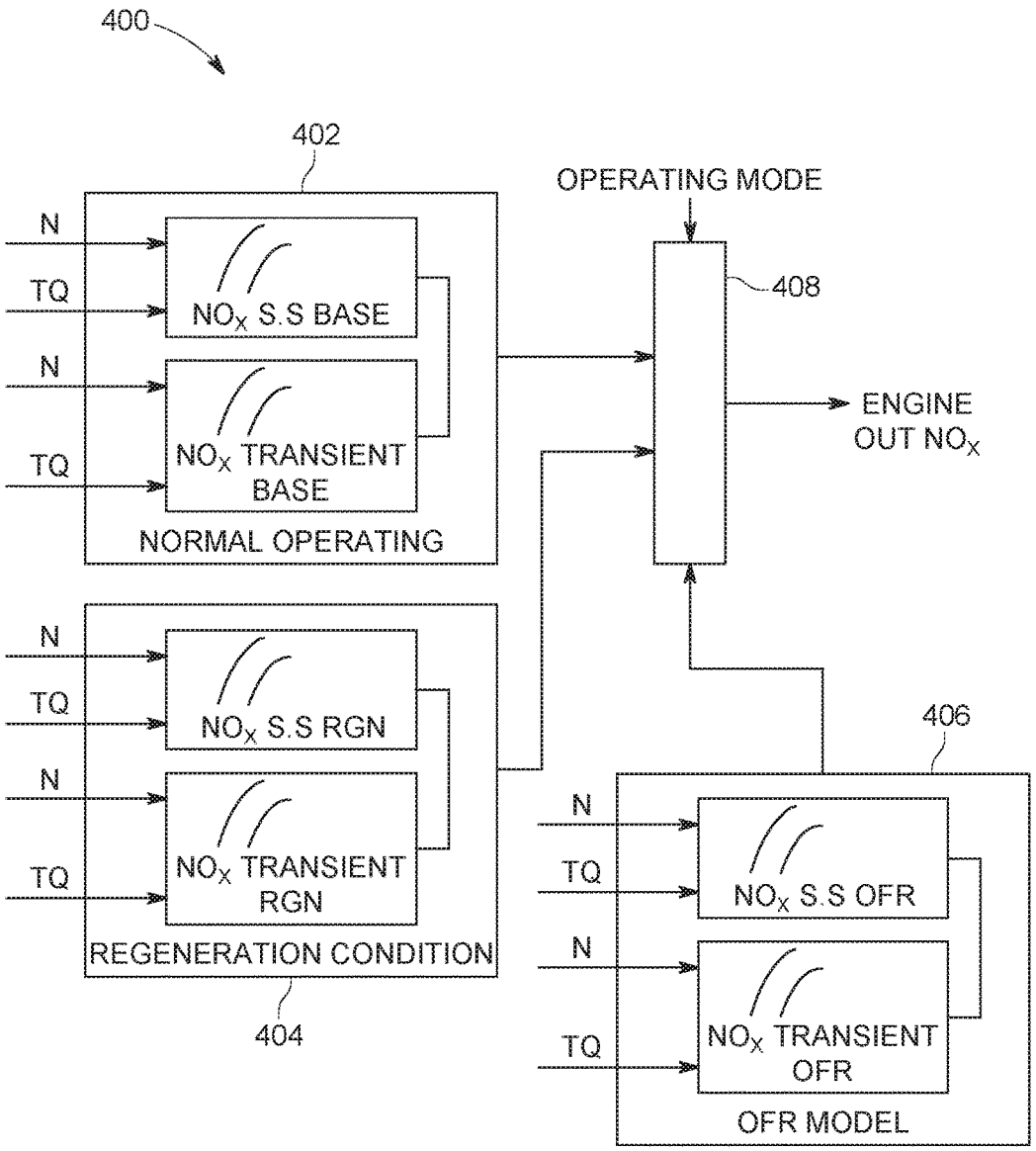
FIG. 4 is a schematic illustration of exemplary control logic for determining the $NO_x$ level in an engine's exhaust according to certain embodiments of the present technology.

FIG. 4 is a schematic illustrating control logic for determining $NO_x$ level according to certain aspects of at least one embodiment of the present technology. The control logic of FIG. 4 includes a plurality of logic blocks configured to provide $NO_x$ estimates as a function of the engine's operating mode. In the illustrated example, the control logic includes a Normal Operating Mode $NO_x$ estimator 402, a Regeneration Operating Mode $NO_x$ estimator 404 and an OFR Mode $NO_x$ estimator 406. Each of the estimators 402-406 determines a $NO_x$ estimate corresponding to level of $NO_x$ produced by the engine during a respective operating mode. A selector 408 sets a final $NO_x$ estimate to the output of one of the estimators 402-406 in dependence on the engine's current operating mode, e.g., as provided by the ECU 26. For example, when the engine is operating in a regeneration mode, the selector 408 uses the output of Regeneration Operating Mode $NO_x$ estimator 404 as the final estimated the $NO_x$ value.

Although not shown in detail, each of the estimators 402-404 can include control logic similar to the control logic 300 shown in FIG. 3. In this regard, each of the estimators 402-206 may include logic that determines a first or steady state $NO_x$ value ($NO_x$_SS) corresponding to the $NO_x$ produced at a given engine operating condition, e.g., steady state (and at a given engine speed (N) and load (TQ) combination) when the engine is operating in a respective mode, e.g., normal, regeneration or OFR. Similarly, each estimator 402-406 may include logic that determines a second or transient $NO_x$ value ($NO_x$_T) corresponding to the $NO_x$ produced at a given engine operating condition, e.g., transient operation (and at a given engine speed (N) and load (TQ) combination) when the engine is operating in a respective mode, e.g., normal, regeneration or OFR. The estimators 402-406 may also include logic (not shown) that determines a compensation factor based on intake manifold pressure and applies the compensation factor to the steady state and transitory $NO_x$ estimates to arrive at a final $NO_x$ estimate. As explained above, in some embodiments, the compensation factor weights the final $NO_x$ estimate towards the transitory $NO_x$ estimate with decreasing intake manifold pressure. The final $NO_x$ estimates from the estimators 402-406 are supplied to the selector 408, which in turn sets the final estimated NOx value to the output of one of the estimators 402-406 in dependence on the engine operating mode, e.g., as provided by the ECU 26.

Figure 5:
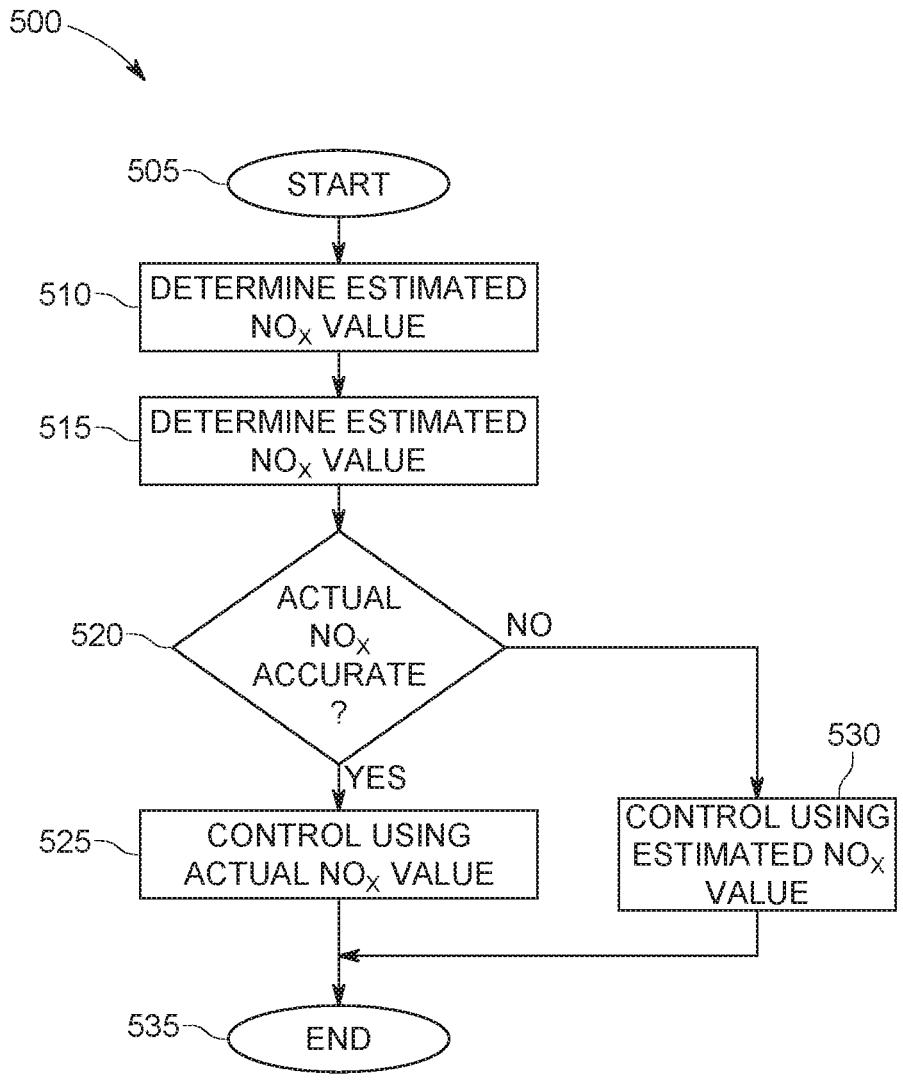
FIG. 5 is a flow diagram of an exemplary method for controlling operation of an internal combustion engine according to certain embodiments of the present technology.

FIG. 5 is a flow diagram of an exemplary method 500 for controlling operation of an internal combustion engine according to certain embodiments of the present technology. The method begins in step 505. Control is then passed to step 510 where the method determines an estimated $NO_x$ value based on the engine speed (N), load (TQ) and intake manifold pressure (IMP). In at least some embodiments, the method 200 of FIG. 2 may be used to determine the estimated $NO_x$ value in step 510. Control is then passed to step 515 where the method 500 determines an actual $NO_x$ value using the $NO_x$ sensor 60. Control is then passed to step 520 where the method determines whether the actual $NO_x$ value is accurate. If the actual $NO_x$ value is determined to be accurate, control is passed to step 525, causing the engine to be controlled using the actual $NO_x$ value. Conversely, if the actual $NO_x$ value is determined to be inaccurate, control is passed to step 525, causing the engine to be controlled using the estimated $NO_x$ value.

In some embodiments, the method 500 may determine the accuracy of the actual $NO_x$ value by monitoring one or more conditions indicative of whether or not the $NO_x$ sensor 60 is functioning properly. For example, the method can monitor one or more of exhaust gas temperature (T), dew point (DP), oxygen concentration ($O_2$) in the exhaust system, system voltage (V) and any other environmental or operating conditions that could adversely affect the accuracy of the $NO_x$ sensor 60.

Some $NO_x$ sensors may not provide satisfactory accuracy unless the exhaust gas is above a threshold temperature. Accordingly, in some embodiments, engine operation may be controlled using the actual $NO_x$ value when the exhaust gas temperature is at or above a temperature threshold, while engine operation may be controlled using the actual $NO_x$ value when the exhaust gas temperature is below the temperature threshold. Likewise, some $NO_x$ sensors may not provide satisfactory accuracy unless the oxygen concentration of the exhaust gas is above a threshold level. Accordingly, in some embodiments engine operation may controlled using the actual $NO_x$ value when the exhaust gas oxygen concentration is as at or above an oxygen concentration threshold, while engine operation may be controlled using the estimated $NO_x$ value when the exhaust gas oxygen concentration is below the oxygen concentration threshold.

Further, some $NO_x$ sensors may not provide satisfactory accuracy when the dew point is below a threshold level. Accordingly, in some engine operation may be controlled using the actual $NO_x$ value when the dew point is at or above a dew point threshold, while engine operation may be controlled using the estimated $NO_x$ value when dew point is below the dew point threshold.

Figure 6:
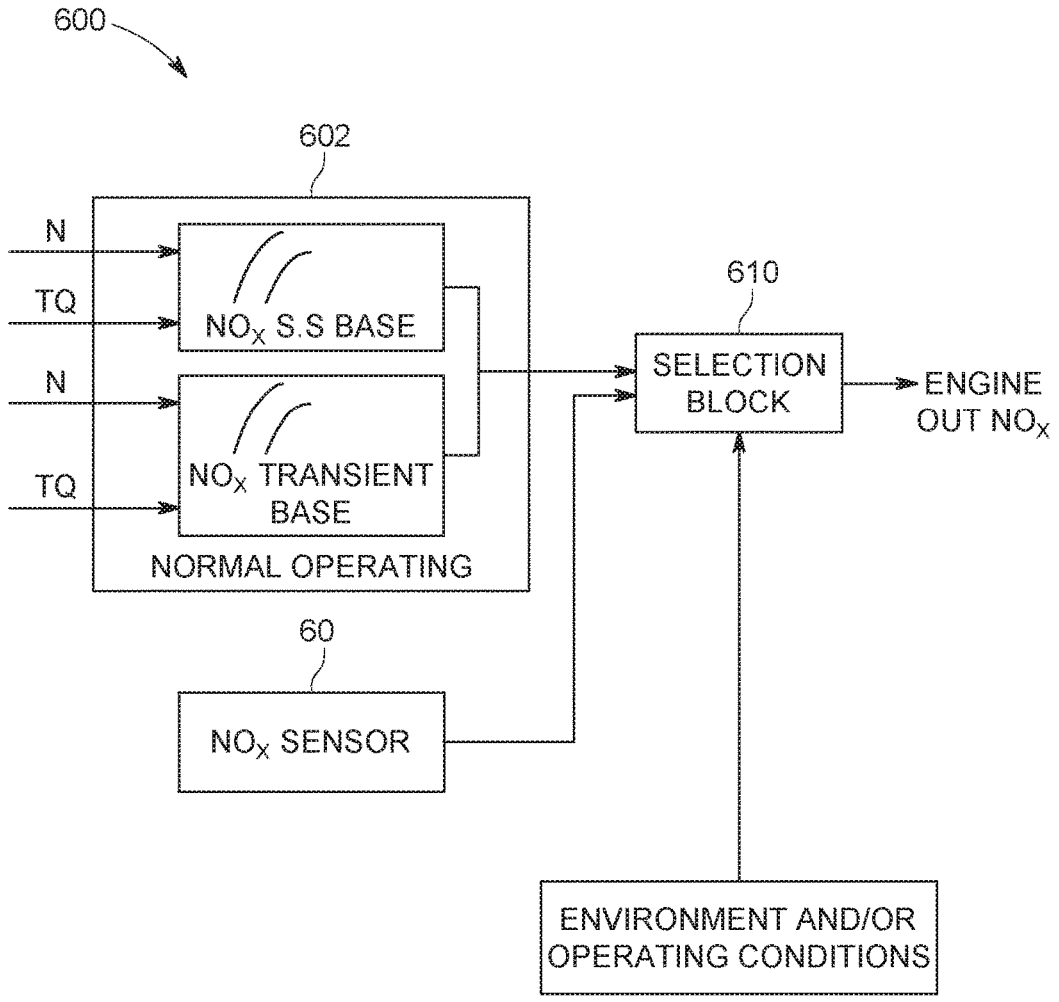
FIG. 6 is a schematic illustration of exemplary control logic for controlling operation of an internal combustion engine according to certain embodiments of the present technology.

FIG. 6 is a schematic illustration of exemplary control logic 600 according to certain embodiments of the present technology. The control logic 600 includes a logic block 602 that produces an estimated ${}_NO_x$ value as a function of at least one engine operating parameter. In at least some embodiments, the logic block 602 may be constructed generally in accordance with the control logic 300 of FIG. 3. Briefly, the logic block 602 may include logic that determines a first or steady state ${}_NO_x$ value (${}_NO_x$_SS) corresponding to the ${}_NO_x$ produced at a given engine operating condition, e.g., steady state (and at a given engine speed (N) and load (TQ) combination). Likewise, the logic block 602 may include logic that determines a second or transient ${}_NO_x$ value (${}_NO_x$_T) corresponding to the ${}_NO_x$ produced at a given engine operating condition, e.g., transient operation (and at a given engine speed (N) and load (TQ) combination). The logic block 602 may also include logic (not shown) that determines a compensation factor based on intake manifold pressure and applies the compensation factor to the steady state and transitory ${}_NO_x$ estimates to arrive at a final ${}_NO_x$ estimate, in the manner described above in connection with FIG. 3. Further, as explained above, in some embodiments, the compensation factor weights the final ${}_NO_x$ estimate towards the transitory ${}_NO_x$ estimate with decreasing intake manifold pressure.

The final $NO_x$ estimate from logic block 602 is supplied to the selection block 610. The selection block 610 also receives the actual $NO_x$ value from the $NO_x$ sensor 60. The selection block 610 determines whether to use the actual $NO_x$ value from the sensor 60 or the estimated $NO_x$ value from the logic block 602 based on one or more parameters or conditions. For example, in some embodiments, the selection block 610 determines whether the actual $NO_x$ value is accurate based on one or more environmental and/or operating conditions. If the actual $NO_x$ value is determined to be accurate, the selection block 610 causes the engine to be controlled using the actual $NO_x$ value. Conversely, if the actual $NO_x$ value is determined to be inaccurate, the selection block 610, causing the engine to be controlled using the estimated $NO_x$ value. In some embodiments, the control logic 610 may determine the accuracy of the actual $NO_x$ value by monitoring one or more conditions indicative of whether or not the $NO_x$ sensor 60 is functioning properly. For example, the method can monitor one or more of exhaust gas temperature (T), dew point (DP), oxygen concentration ($O_2$) in the exhaust system, system voltage (V) and any other environmental or operating conditions that could adversely affect the accuracy of the $NO_x$ sensor 60.

While this disclosure has been described as having exemplary embodiments, this application is intended to cover any variations, uses, or adaptations using the general principles set forth herein. It is envisioned that those skilled in the art may devise various modifications and equivalents without departing from the spirit and scope of the disclosure as recited in the following claims. Further, this application is intended to cover such departures from the present disclosure as come within the known or customary practice within the art to which it pertains. While this disclosure has been described as having exemplary embodiments, this application is intended to cover any variations, uses, or adaptations using the general principles set forth herein. It is envisioned that those skilled in the art may devise various modifications and equivalents without departing from the spirit and scope of the disclosure as recited in the following claims. Further, this application is intended to cover such departures from the present disclosure as come within the known or customary practice within the art to which it pertains.

The invention claimed is:

1. A method for controlling operation of an internal combustion engine, comprising:

determining an estimated $NO_x$ value as a function of at least one engine operating parameter;

determining an actual $NO_x$ value using a $NO_x$ sensor positioned in an exhaust gas stream of the internal combustion engine;

detecting at least one condition indicative of whether or not the actual $NO_x$ value is accurate;

controlling engine operation using the actual $NO_x$ value when the at least one condition indicates that the actual $NO_x$ value is accurate; and controlling engine operation using the estimated $NO_x$ value when the at least one condition indicates that the actual $NO_x$ value is inaccurate.

2. The method of claim 1, wherein the estimated $NO_x$ value is determined as a function of at least engine speed and torque.

3. The method of claim 1, wherein the at least one condition comprises one or more of exhaust gas temperature, dew point, humidity, system voltage, and oxygen concentration of the exhaust gas.

4. The method of claim 1, wherein the at least one condition comprises dew point and wherein:

engine operation is controlled using the actual $NO_x$ value when the dew point as at or above a first predetermined level; and engine operation is controlled using the estimated $NO_x$ value when the dew point is below the first predetermined level.

5. The method of claim 1, wherein the at least one condition comprises oxygen concentration in the exhaust gas stream and wherein:

engine operation is controlled using the actual $NO_x$ value when the oxygen concentration is at or above a predetermined level; and engine operation is controlled using the estimated $NO_x$ value when the oxygen concentration is below the predetermined level.

6. A method for controlling operation of an internal combustion engine having a NOx level output, the method comprising:

determining an actual $NO_x$ value using a $NO_x$ sensor positioned in an exhaust gas stream of the internal combustion engine;

determining a steady state $NO_x$ estimate as a function of at least engine speed and torque, the steady state $NO_x$ corresponding to the $NO_x$ level output by the engine during a steady state operation where engine speed and power are constant;

determining a transitory $NO_x$ estimate as a function of at least engine speed and torque, the transitory $NO_x$ estimate corresponding to the $NO_x$ level output by the engine during a transitory operation where engine power is increasing;

determining a compensation factor based on intake manifold pressure;

applying the compensation factor to the steady state and transitory $NO_x$ estimates to arrive at a final estimated $NO_x$ value, wherein the compensation factor weights the final estimated $NO_x$ value towards the actual $NO_x$ estimate with decreasing intake manifold pressure;

detecting at least one condition indicative of whether or not the actual $NO_x$ value is accurate;

controlling engine operation using the actual $NO_x$ value when the at least one condition indicates that the actual $NO_x$ value is accurate; and controlling engine operation using the final estimated $NO_x$ value when the at least one condition indicates that the actual $NO_x$ value is inaccurate.

7. The method of claim 6, wherein the estimated $NO_x$ value is determined as a function of at least engine speed and torque.

8. The method of claim 6, wherein the at least one condition comprises one or more of exhaust gas temperature, dew point, system voltage, and oxygen concentration of the exhaust gas.

9. The method of claim 6, wherein the at least one condition comprises dew point and wherein:

engine operation is controlled using the actual $NO_x$ value when the dew point as at or above a predetermined level; and engine operation is controlled using the estimated $NO_x$ value when the dew point is below the predetermined level.

10. The method of claim 6, wherein the at least one condition comprises oxygen concentration in the exhaust gas stream and wherein:

engine operation is controlled using the actual $NO_x$ value when the oxygen concentration is at or above a predetermined level; and engine operation is controlled using the estimated $NO_x$ value when the oxygen concentration is below the predetermined level.

11. A method as set forth in claim 6, wherein the step of determining a compensation factor further comprises:

determining an estimated intake manifold pressure as a function of at least engine speed and torque;

sensing the actual intake manifold pressure; and determining the compensation factor as a function of a difference between the actual and estimated intake manifold pressures.

12. A method as set forth in claim 11, wherein the compensation factor is also a function one or more of exhaust manifold pressure, mass air flow, turbocharger boost, exhaust flow, and combinations thereof.

13. A method as set forth in claim 6, wherein the compensation factor has a value ranging from 0 to 1 and wherein the final $NO_x$ estimate is determined in accordance with the following formula:

$$NO_{x_OUT_EST}=(CF \cdot NO_x_T)+((1-CF) \cdot NO_x_SS)$$

where CF is the compensation factor, $NO_x_T$ is the transient $NO_x$ estimate and $NO_x_SS$ is the steady state $NO_x$ estimate.

* * * * *